US005636957A

United States Patent [19]

Hefty

[11] Patent Number: 5,636,957

[45] Date of Patent: *Jun. 10, 1997

[54] METHOD OF MAKING PERSONALIZED CHILDREN'S STORYBOOK UTILIZING STICKERS

[76] Inventor: John B. Hefty, 976 Grand Canal St., Gulf Breeze, Fla. 32561

[ * ] Notice: The portion of the term of this patent subsequent to Aug. 29, 2011, has been disclaimed.

[21] Appl. No.: 453,373

[22] Filed: May 30, 1995

Related U.S. Application Data

[63] Continuation of Ser. No. 151,893, Nov. 15, 1993, Pat. No. 5,454,678.

[51] Int. Cl.[6] ..... B42C 19/00; B42D 1/00

[52] U.S. Cl. ..... 412/1; 281/15.1; 203/63.1; 203/81; 203/67

[58] Field of Search ..... 281/15.1; 283/81, 283/63.1, 67, 117; 412/1

[56] References Cited

U.S. PATENT DOCUMENTS 5,190,316 3/1993 Hefty ..... 281/15.1
5,454,678 10/1995 Hefty ..... 412/1

*Primary Examiner*—Frances Han
*Attorney, Agent, or Firm*—George A. Bode; Bode & Associates

[57] ABSTRACT

A method of making a personalized children's storybook using preprinted books and inserting stickers containing personalized data to create a personalized book.

4 Claims, 2 Drawing Sheets

METHOD OF MAKING PERSONALIZED CHILDREN'S STORYBOOK UTILIZING STICKERS

This application is a continuation of application Ser. No. 08/151,893, filed Nov. 15, 1993, now U.S. Pat. No. 5,454,678 issued Oct. 3, 1995.

BACKGROUND AND INTRODUCTION

The invention pertains to a method of making a book and the book itself. More particularly, the invention pertains to a method of making a personalized children's storybook using preprinted books and inserting stickers containing personalized data to create a personalized book.

The present invention is an advance over the prior art because until now personalized books could not be sold off the shelf because they were still in pieces until the personalized data was added (see U.S. Pat. No. 3,982,744). Personalized books could only be sold through mail order and received after several weeks of waiting by the customer, or sold on site and manufactured for the customer while the customer waited while the personalized book was being printed and assembled. The present invention allows preprinted personalized books to be merchandized throughout the country on bookshelves. In one embodiment of the present invention, the customer can give a telephone operator the personalized data and receive by mail a sheet of stickers containing the personalized data to be placed in the preprinted book.

SUMMARY OF THE INVENTION

In one aspect, the present invention provides a method of making a personalized book wherein a specially preprinted book is prepared and adapted to have personalized stickers inserted at specific locations in the preprinted book so as to match up with sections requiring the personalized data on the personalized stickers. The preprinted book can be produced by conventional methods and contains non-variable text and also usually contains illustrated matter. The non-variable text comprises general information which does not change or vary from book to book of the same title. The personalized stickers comprises specific information which changes or varies for each book depending on the recipient of the book. These personalized stickers are determined by the identity of the intended recipient of the book. When the purchaser of the book specifies the individual for whom the book is to be personalized, the printer conveys the information to an appropriate source for printing of the personalized stickers.

BRIEF DESCRIPTION OF THE DRAWINGS

The present invention will be further understood from the accompanying drawings, wherein.

DETAILED DESCRIPTION OF THE INVENTION

Figure 1:
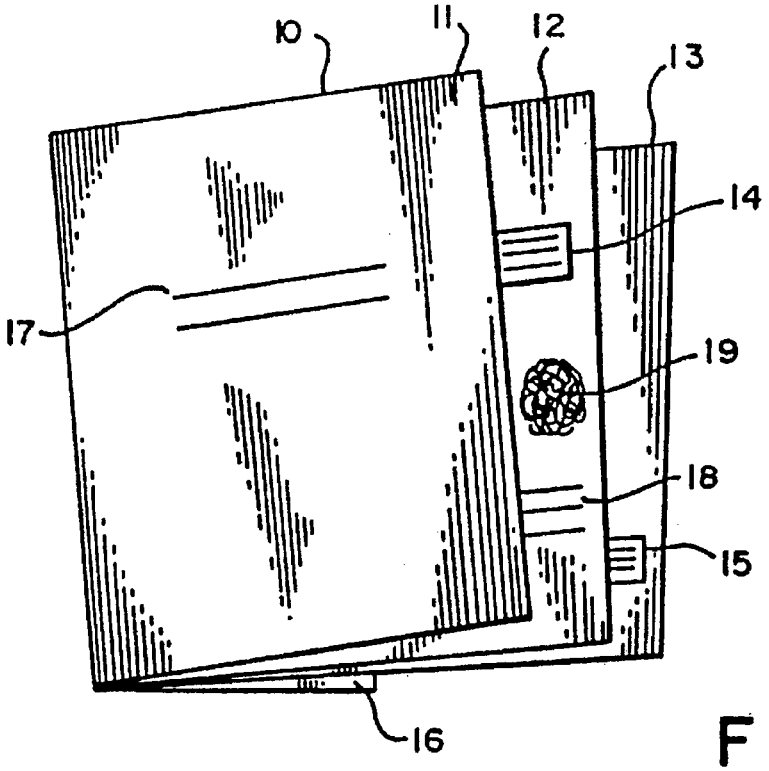
FIG. 1 is a perspective view of a children's storybook made in accordance with the present invention.

In further detail and with reference to the drawings, FIG. 1 shows a preprinted book 10 containing a plurality of pages

12, 13, etc. and a front cover 11 and a back cover 16. The book is made and bound using conventional methods known in the art. The book can be mass produced and purchased by a Buyer from a Seller. The non-variable text 18 (optionally including the title 17) includes general information that is common to every book of the same title. Typically, the non-variable text 18 includes a children's story having a theme to which most children can generally relate. For example, the children's story can concern a story about a child. Various sections of the preprinted book are to be replaced with personalized stickers 14, 15 containing personalized information, i.e., child's name, time and place where child was born, height and weight of child, etc., based on the intended recipient of the book. The book can optionally contain illustrations 19.

Figure 2:
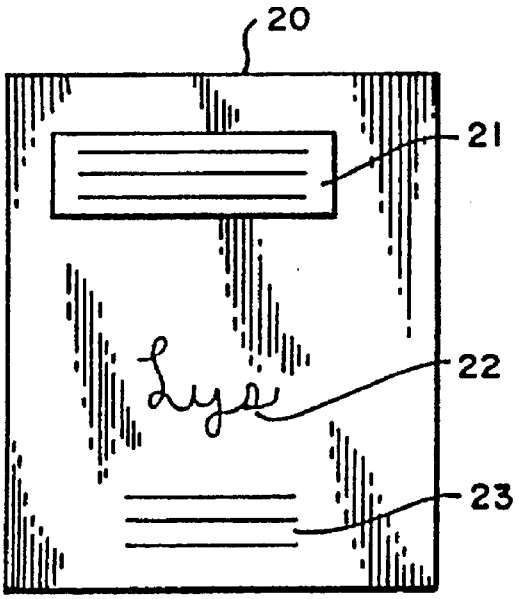
FIG. 2 is a plan view of a page from the book showing the stickers according to the invention.

FIG. 2 is a representation of a single page 20 from the storybook of the invention showing the preprinted illustration 22, preprinted non-variable text 23, and the personalized sticker 21 which has replaced a section of the preprinted book intended to be replaced with a personalized sticker.

Figure 3:
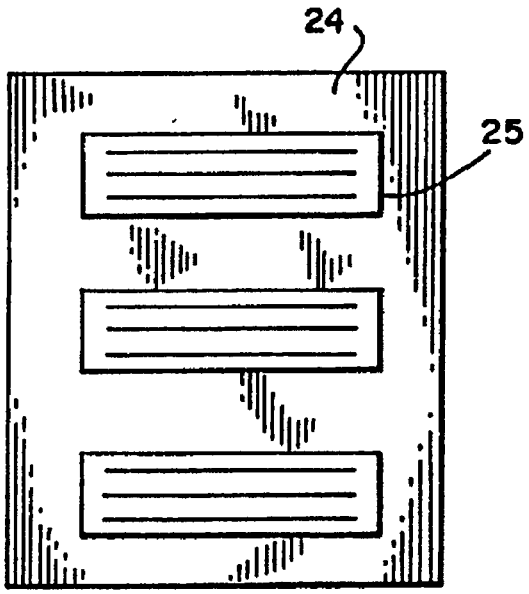
FIG. 3 is a plan view of a page of stickers in accordance with the invention.

Personalized data are printed on adhesive stickers by the Printer. The Buyer will give the Printer of the stickers the personalized data at the time the preprinted book is purchased or at a later date. The stickers are then made. FIG. 3 shows a page 24 of the book containing a plurality of personalized stickers 25. The variable text includes specific, personal information about a child who is the recipient the book. Typically, the variable text includes the name, address, and age of the child, names of friends and/or relatives of the child, as well as other information of a personal nature about the child. The stickers are printed using conventional methods, for example a laser printer. The adhesive stickers can be self-adhesive "peel off" type or may require the addition of an adhesive. The adhesive sticker containing the new personalized data is pressed against the appropriate area of the book (i.e., the section to be replaced) to thereby form a personalized book. The sticker containing the personalized data will thus replace the section of the preprinted book which was to be replaced with the personalized sticker. The Buyer will know which of the personalized stickers goes on which page because of the personalized data contained on the sticker; for example, if the section of the preprinted book calls for "place where baby was born" then the personalized sticker containing that information will replace that section. Alternatively, the stickers will replace numbered blank sections in the storybook; the stickers can be numbered so that the Buyer will know which sticker will replace which numbered blank section.

Figure 4:
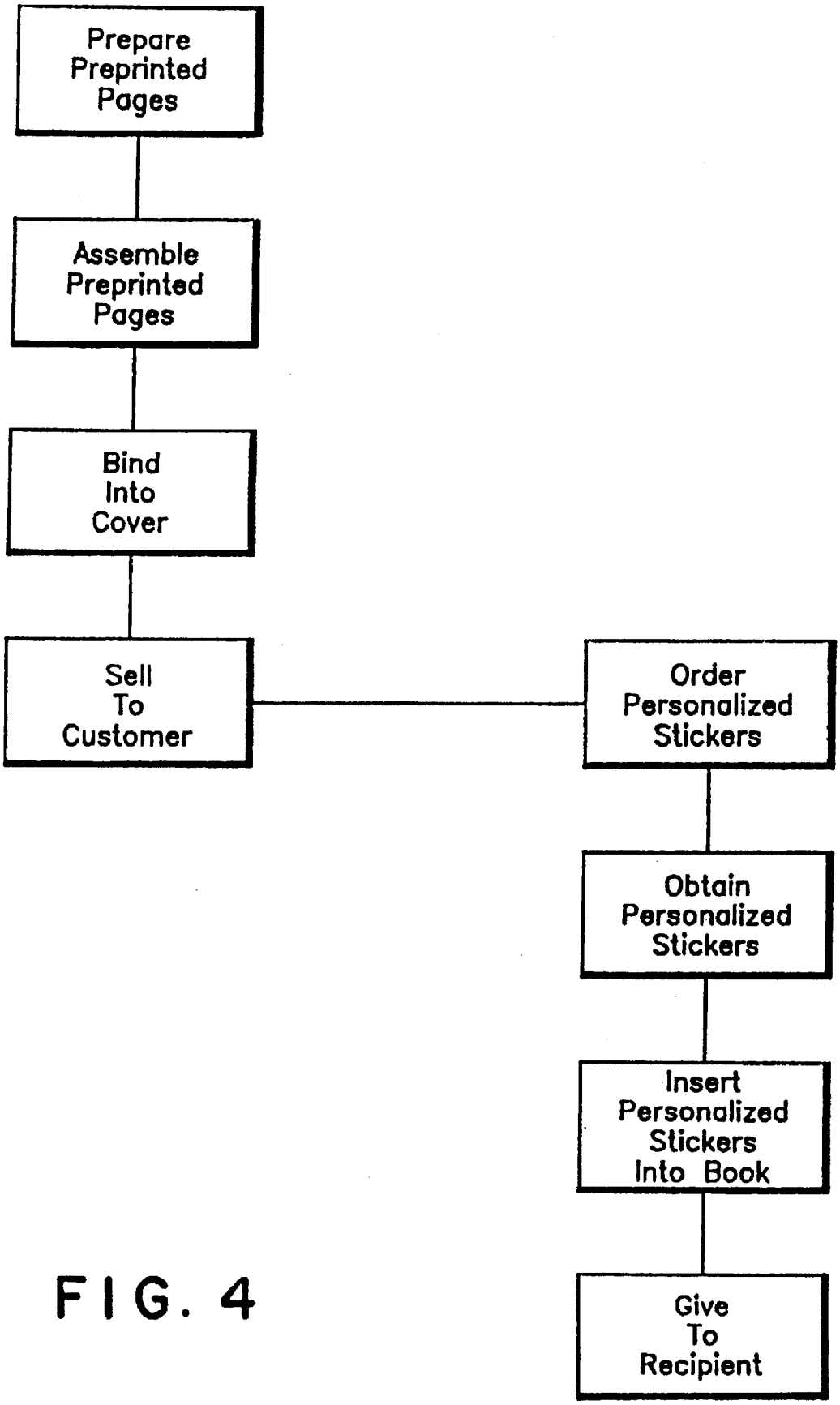
FIG. 4 is a typical flow chart showing how the present invention is carried out.

FIG. 4 is a schematic flow diagram illustrating the overall process.

The stickers being utilized can be blended into the background of the preprinted book. The way to "hide" the sticker containing the new text may include coloring the sticker in the same pattern as the area on which it is to be placed. The sticker can be a copy of a part of a particular page in the preprinted book and would replace the corresponding part of the preprinted book. The sticker would blend in with the background of the page but have the appearance of being printed directly on the page. In addition, the stickers can contain drawings (e.g., the sun, the stars, a mailbox with the recipient's name). The stickers can also be made of a special material which will become hardly visible when affixed to the appropriate place on the preprinted page.

Although the invention has been described with reference to preferred embodiments, numerous modifications and rearrangements can be made with the result still coming within the scope of the invention.

U.S. Pat. No. 5,190,316 which is relied on and incorporated herein by reference in its entirety.

What is claimed is:

1. A to-be-completed personalized children's storybook comprising: .

a preprinted storybook containing a children's story, optional preprinted illustrations, a plurality of blank sections and a plurality of preprinted sections at selected locations requesting personalized information about the intended recipient of said storybook, wherein either said preprinted or said blank sections or, said preprinted and said blank sections, are to be replaced with adhesive personalized stickers, and, said adhesive personalized stickers adapted to replace said sections so as to change said storybook to a personalized storybook concerning said intended recipient, said stickers containing personalized data about the recipient of said storybook requested by said sections.

2. A to-be-completed personalized children's storybook comprising:

a preprinted storybook containing a children's story, optional preprinted illustrations, a plurality of numbered blank sections and a plurality of preprinted sections at selected locations requesting personalized information about the intended recipient of said storybook, wherein either said preprinted or said blank sections or, said preprinted and said blank sections, are to be replaced with said adhesive personalized stickers, and, said adhesive personalized stickers adapted to replace said sections so as to change said storybook to a personalized storybook concerning said intended recipient, said stickers containing personalized data about the recipient of said storybook requested by said sections.

3. A to-be-completed personalized children's storybook comprising:

a preprinted storybook containing a children's story, an optional preprinted title, optional preprinted illustrations, a plurality of preprinted sections at selected locations requesting personalized information about the intended recipient of said storybook, wherein said sections are to be replaced with adhesive personalized stickers, and, said adhesive personalized stickers adapted to replace said sections so as to change said storybook to a personalized storybook concerning said intended recipient, said stickers containing personalized data about the recipient of said storybook requested by said sections.

4. The storybook of claim 3, wherein said personalized data is printed by a laser printer.

* * * * *